US006193384B1

(12) United States Patent
Stein

(10) Patent No.: US 6,193,384 B1
(45) Date of Patent: Feb. 27, 2001

(54) CEILING FAN SIGN

(76) Inventor: Buckminster G. Stein, 12 T. Huxley La., Missouri City, TX (US) 77459

( * ) Notice: Subject to any disclaimer, the term of this patent is extended or adjusted under 35 U.S.C. 154(b) by 0 days.

(21) Appl. No.: 09/271,067

(22) Filed: Mar. 17, 1999

Related U.S. Application Data

(60) Provisional application No. 60/078,427, filed on Mar. 18, 1998.

(51) Int. Cl.[7] ..... F21Y 101/02; F21W 121/00

(52) U.S. Cl. ..... 362/96; 362/812

(58) Field of Search ..... 362/96, 812, 253, 362/311, 285

(56) References Cited

U.S. PATENT DOCUMENTS

| | | | | |
|---|---|---|---|---|
| 4,064,427 | * | 12/1977 | Hansen et al. | 362/96 |
| 4,689,604 | | 8/1987 | Sokol . | |
| 5,028,206 | * | 7/1991 | Kendregan | 362/96 |
| 5,041,947 | | 8/1991 | Yuen et al. . | |
| 5,057,827 | | 10/1991 | Nobile et al. . | |
| 5,072,341 | * | 12/1991 | Huang | 362/96 |
| 5,082,422 | | 1/1992 | Wang . | |
| 5,224,830 | | 7/1993 | Wang . | |
| 5,302,965 | | 4/1994 | Belcher et al. . | |
| 5,437,540 | * | 8/1995 | Blocker et al. | 362/96 X |
| 5,528,469 | * | 6/1996 | Todd, Jr. | 362/96 |
| 5,575,553 | | 11/1996 | Tipton . | |
| 5,672,002 | | 9/1997 | Todd, Jr. . | |
| 5,800,049 | * | 9/1998 | Todd, Jr. | 362/96 X |
| 6,036,331 | * | 3/2000 | Acquisto | 362/96 |

OTHER PUBLICATIONS

"Electronic Skywriter Paints Glowing Warnings In The Air" by Pupular Science magazine, Jun. 1997 Place of Publication: U.S. Page No.: Unknown.

* cited by examiner

*Primary Examiner*—Laura K. Tso
(74) *Attorney, Agent, or Firm*—Mark A. Oathout

(57) ABSTRACT

An image/message display device includes a ceiling fan suspended from the ceiling. A controller for the display is mounted on the ceiling fan and includes hall effect sensors for determining the rotational speed of the fan. LED panels are mounted on each of the blades for creating the image/message as the ceiling fan turns. Aerodynamic covers are placed over the LED panels. A dark, non-reflective background may be suspended behind the LED panels to enhance the view of the image/display.

20 Claims, 4 Drawing Sheets

CEILING FAN SIGN

This application is a continuation in part of U.S. Provisional Application Ser. No. 60/078,427 filed Mar. 18, 1998.

SUMMARY OF THE INVENTION

An image/message display device includes a ceiling fan suspended from the ceiling. A controller for the display is mounted on the ceiling fan and includes hall effect sensors for determining the rotational speed of the fan. LED panels are mounted on each of the blades for creating the image/message as the ceiling fan turns. Aerodynamic covers are placed over the LED panels. A dark, non-reflective background may be suspended behind the LED panels to enhance the view of the image/display.

DETAILED DESCRIPTION

Figure 1:
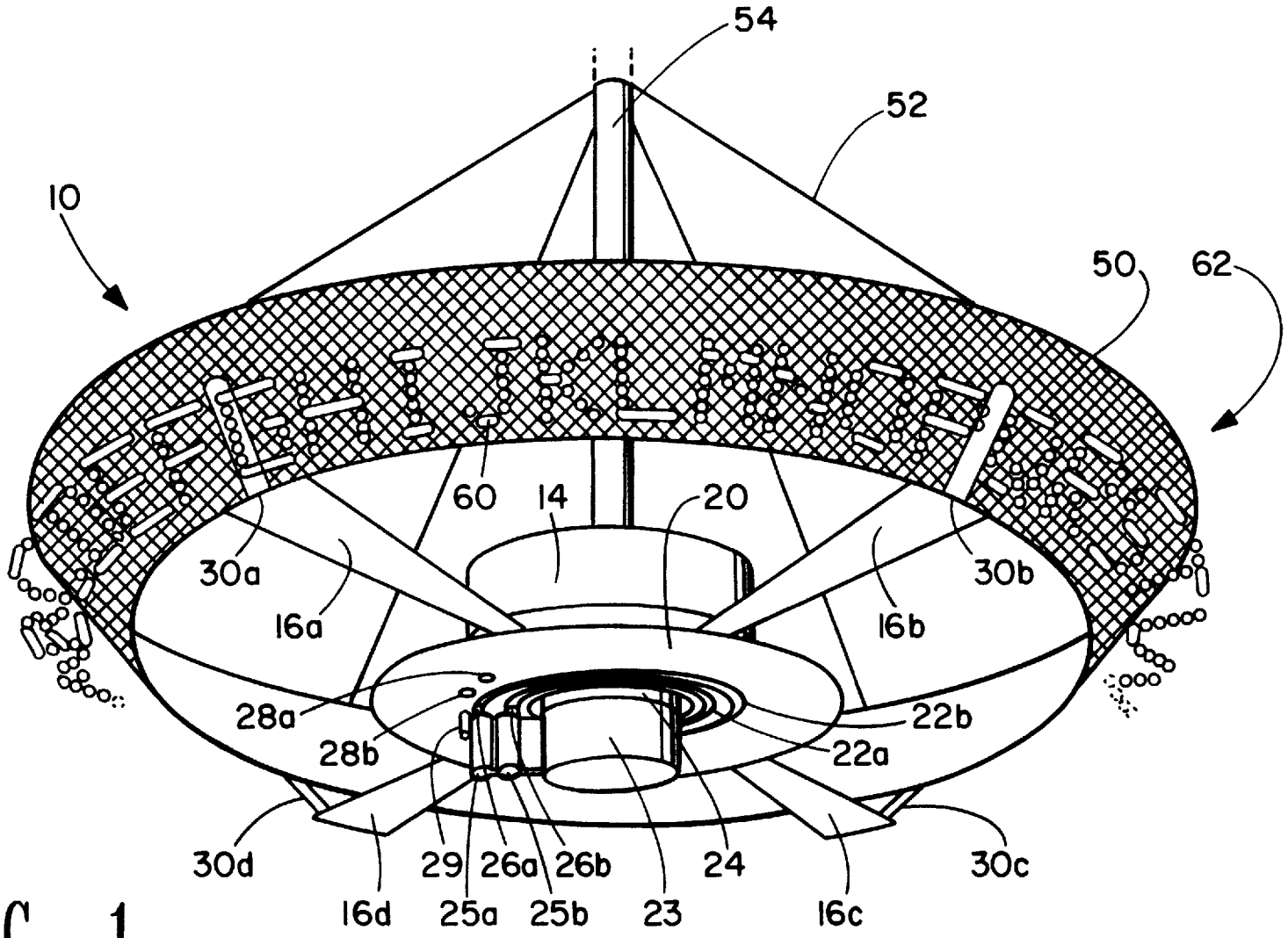
FIG. 1 is perspective view of the invention.

The ceiling fan image display device 10 takes advantage of the human eye's ability to retain bright images for a few hundreds of a second. If a Light Emitting Diode (LED) 32, or other light source such as laser diode is mounted at the end of a rotating fan blade 16*a* and activated, the eye will perceive a circular line at the outside circumference of the fan blade 16*a*. If an LED 32 is switched on and off at a frequency 50 times as fast as the fan's rpm, the eye would perceive a dashed circular line broken in 50 places. If a vertical column of seven LEDs 30*a,b,c,d*, were mounted at the end of a fan blade 16*a,b,c,d* and were controlled individually, five by seven pixel characters could be formed to display a circular message 62. In addition, if separate columns of different color light sources 32 are used, custom colored graphics and messages 62 may be created. In addition, all blades on the fan could have LEDS for a brighter or clearer image. The images 60 and messages 62 are very useful as an attractive or attention getting form of advertising in places which use ceiling fans 14 including restaurants, bars, airports, hotels, and sporting facilities.

FIG. 1 shows an example of the present invention 10 generally comprising a ceiling fan 14, a doughnut shaped circuit board/controller 20, Hall effect sensors 28*a,b*, magnet 29, LED panels 30*a,b,c,d*, and aerodynamic protective dust covers 40*a,b,c,d*. The ceiling fan image display device 10 is easily adaptable to existing fans 14 because the device 10 is powered from auxiliary power lines reserved for light clusters or fixtures. These auxiliary lines power a power supply 23 which is mounted below the fan's switch box 24. The output of the power supply 23 is connected directly to conductive brushes 25*a,b*. The tip 26*a,b* of each brush 25*a,b* contacts an electronic slip ring 22*a,b*.

The slip rings 22*a,b* as shown are part of a doughnut-shaped circuit board/controller 20. Power is transferred from the auxiliary power lines, to the step-down power suppy 23, to the brushes 25*a,b*, to the electronic slip rings 22*a,b*, then to the controller 20.

The circuit board 20 may be of a variety of designs such as, for example, doughnut-shaped and mounted around the switch box 24 to the underside of the fan blades 16*a,b,c,d*.

The controller 20 could be made of one or several pieces and can be round, square or other shapes. It is to be appreciated that many other shapes or configurations with similar advantages are possible. The controller 20 could be mounted on the ends or other portions of the blade but would typically be mounted toward the center. The making of a functional circuit board 20 within these confines and the software for use with same is within the range of skills of one of ordinary skill in the art. Although it is recognized that manufacturing the circuit board 20 in a doughnut shape is more costly than conventional rectangular designs, there are four significant advantages. First, the circular center hole allows the board 20 to be mounted close to the underside of the fan blades 16*a,b,c,d* and around the switch box 24 which is close to the stationary power supply 23. This shortens the path of electric power from the auxiliary power lines to the circuit board 20. Second, the circular design allows all the ribbon cables 21*a,b,c,d* to be of equal shape/length and thus equal weight. This provides a balanced design which prevents wobbling of the fan 14 during rotation (wobbling may distort the perceived image 60 as it can result in light sources rotating in different circles with different diameters). Third, the electronic slip rings 22*a,b* may be manufactured as part of the control circuit board 20 eliminating a separate assembly and reducing cost. Fourth, the doughnut shape allows one circuit board 20 to be used with three, four, five, and six blade fans without the need to rebalance each type of fan.

The controller 20 can adapt automatically to ceiling fans 14 with bidirectional rotation and multiple speeds. The controller 20 includes multispeed compatible software, two Hall effect sensors 28*a,b* and a magnet 29 for determining the rotational speed and direction of the blades 16*a,b,c,d*. The magnet 29 is mounted to be stationary near the controller 20. The Hall effect sensors 28*a,b* are mounted on the controller 20 close to each other and in a position to pass directly over the magnet 29 as the fan blades 16*a,b,c,d* rotate. With each revolution of the fan blades 16*a,b,c,d*, the controller 20 can compute the rotational direction and speed of the fan blades 16*a,b,c,d*.

Determining when to activate specific LEDs 32 depends on the rotational speed of the blades 16*a,b,c,d*, the blade 16 position, and the message 62 to be displayed. If the rotational speed of the blades 16*a,b,c,d* is above a minimum threshold to present an image 60 which is perceptible to the eye without strobing, the controller 20 determines which LEDs 32 on the panels 30*a,b,c,d* will be activated at any point in time. Several images 60 can be used to create a message 62 with text and/or graphics. The image 60 or message 62 may be made to appear stationary or to scroll depending on the sequencing of the LEDs 32. A scrolling message 62 permits viewers to see the entire image or message 62 from all points surrounding the display device 10.

To maintain the same image 60, the LEDs 32 must turn on and off at a proportionally higher frequency for a higher rotational velocity and vice versa. Higher rotational velocity and higher blade 16 count result in a smoother and clearer image 60 because the image 60 is refreshed at a higher rate. LED panels 30*a,b,c,d* are composed of a series of LEDs 32. The panels 30*a,b,c,d* are connected to the controller 20 by ribbon cables 21*a,b,c,d* starting at a connector on the controller 20 and running along the top of the blades 16*a,b,c,d* and to the LED display panels 30*a,b,c,d*. Panels 30*a,b,c,d*, are mounted at the outside end and on top of the blades 16*a,b,c,d*. Mounting LED panels 30*a,b,c,d* on each of the fan blades 16*a,b,c,d* compared to mounting an LED panel 30 on only one fan blade 16 reduces strobing effects and produces a brighter image 60.

Figure 2:
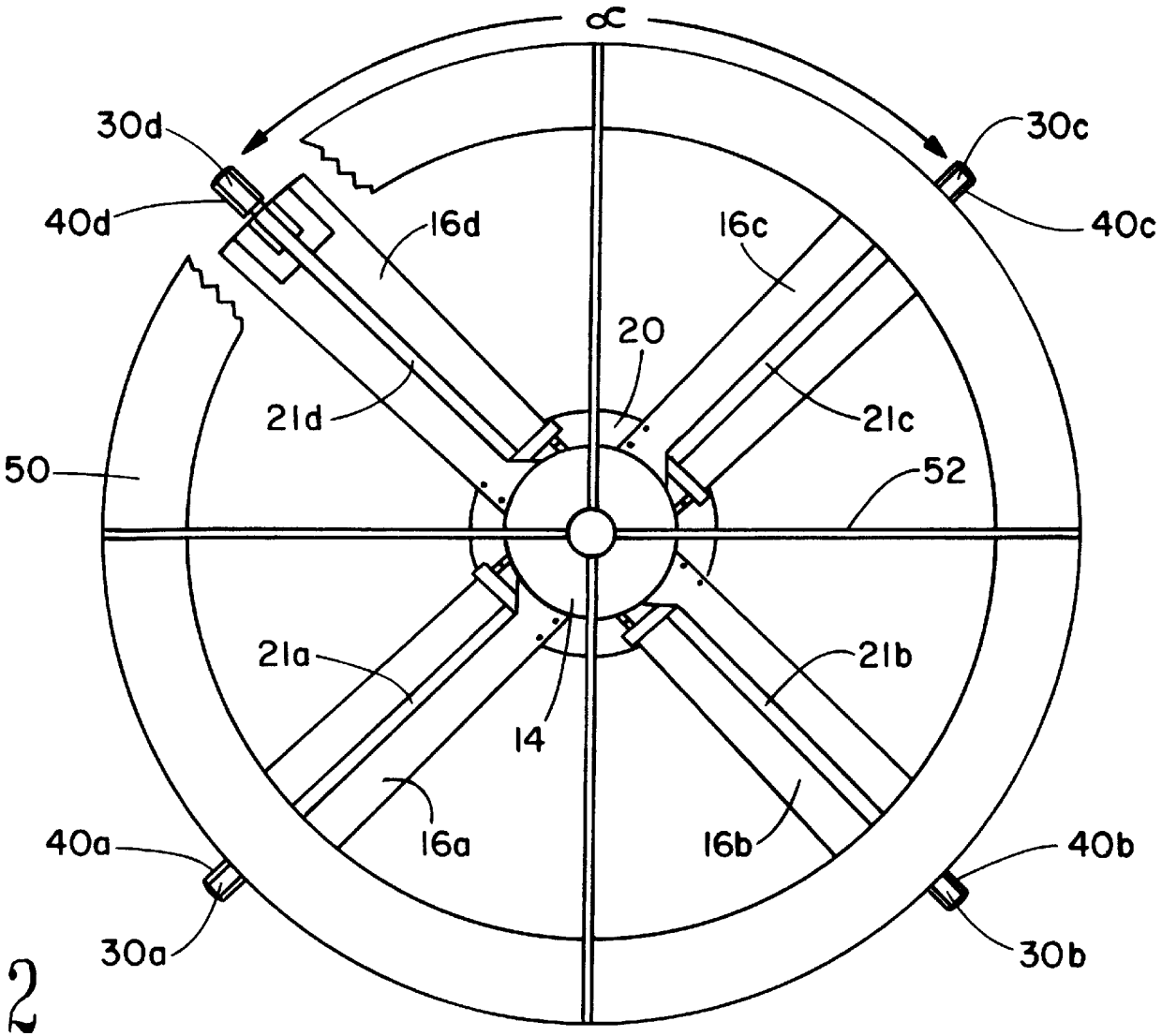
FIG. 2 is a top view of the invention.
Figure 3:
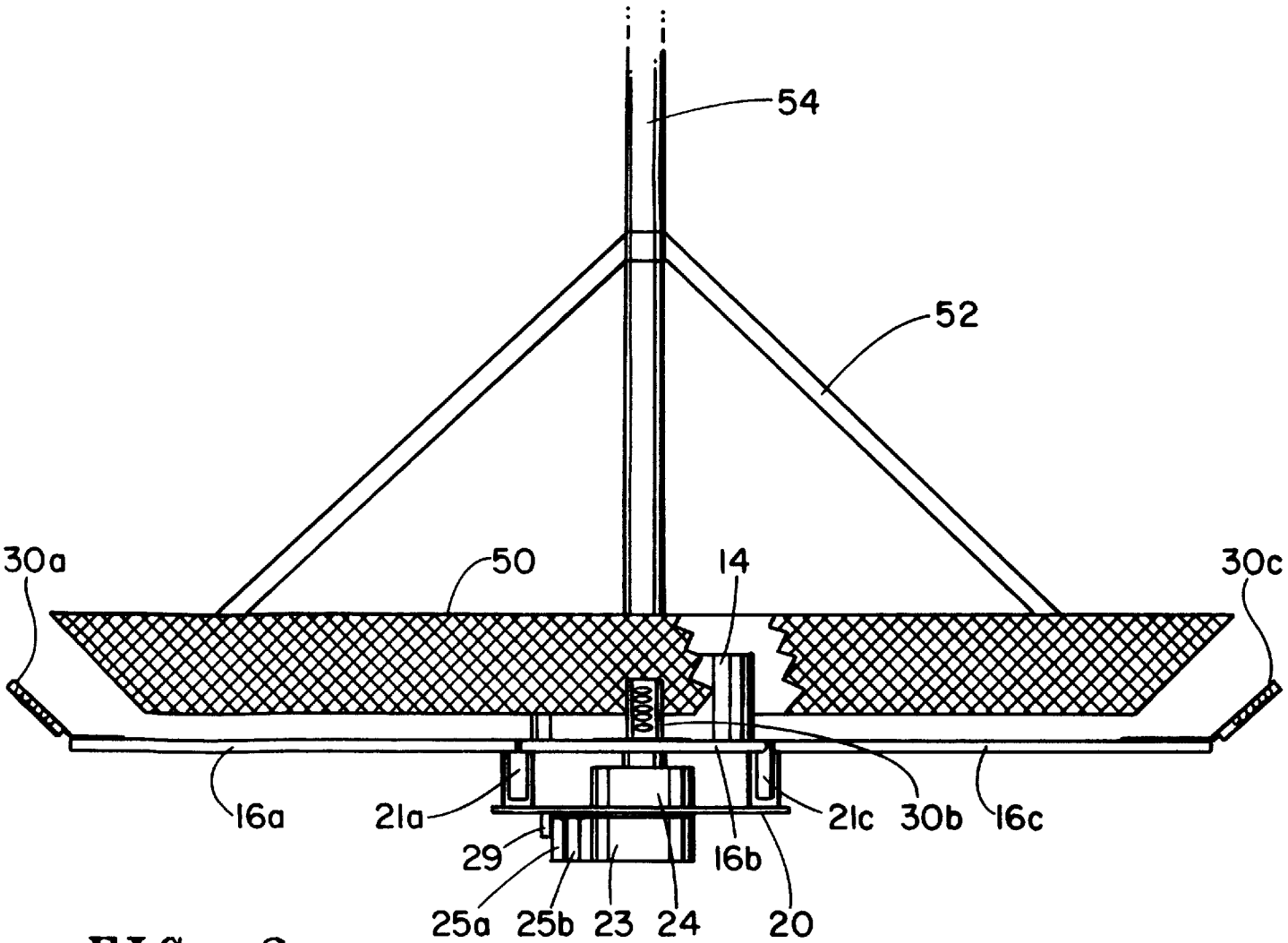
FIG. 3 is a elevational view of the invention.
Figure 4:
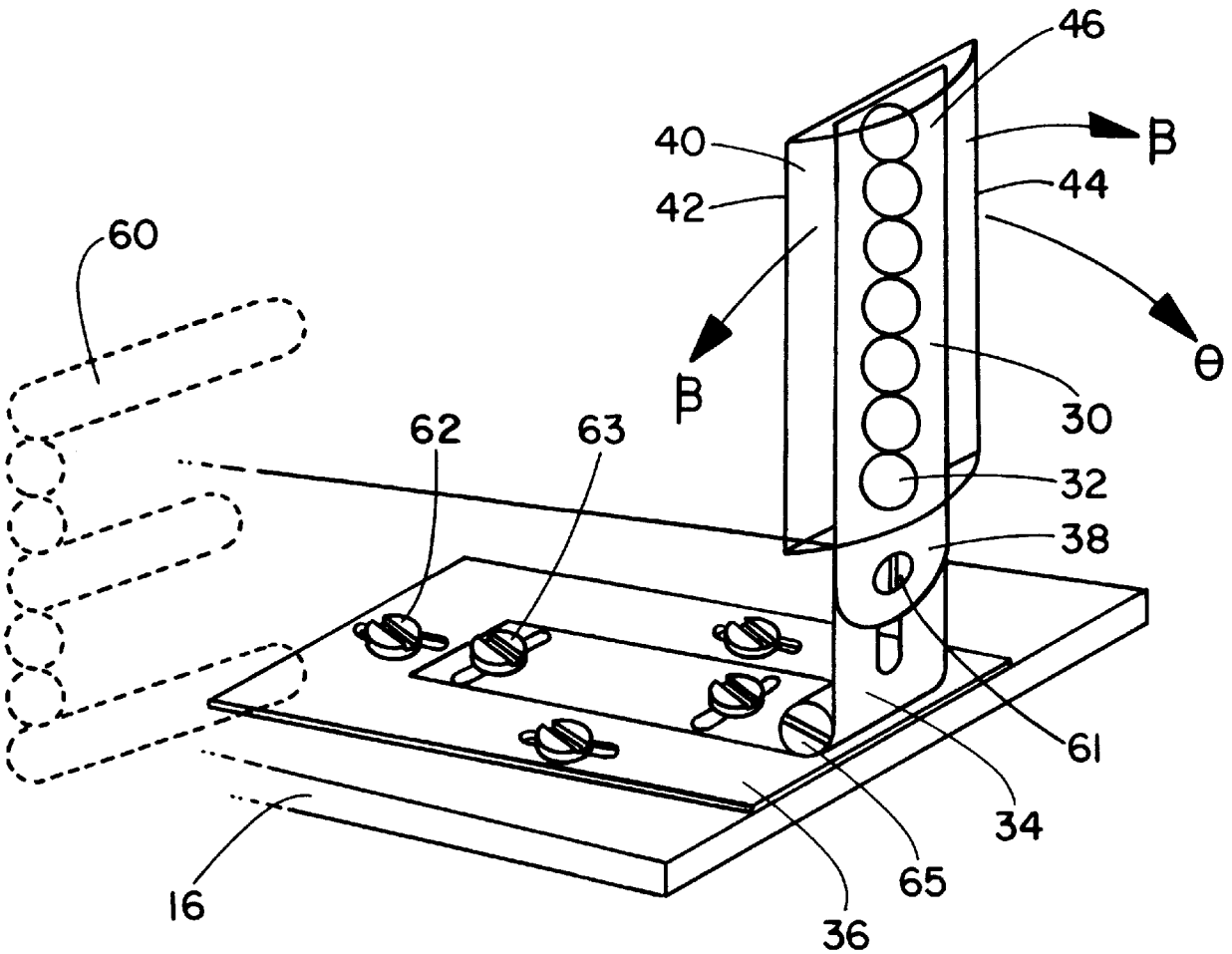
FIG. 4 is a perspective view of an LED panel mounted on the end of a blade with a cover and various alignment devices.

The LED panels must be aligned to produce an optimal/consistent image 60. For alignment, the LED panels 30*a,b,c,d* may be mechanically adjusted to produce the clearer image 60. Referring to FIG. 4, five different position adjustments (vertical, radial, radial angle, italicizing angle and forward viewing angle) of the LED panels 30*a,b,c,d* are a significant part of display device 10. First, vertical adjustment of the LED panels 30*a,b,c,d* is made via screw 61 in a slot on bracket 34 which allows the raising or lowering of the height of the panels 30*a,b,c,d*. Second, the LED panel 30*a,b,c,d* radial distance from the axis of rotation may be varied via screws 62 in slots on plate 36. Third, the radial angle $\alpha$ (FIG. 2) between adjacent LED panels 30*a,b,c,d* in the horizontal plane needs to be equal. This adjustment may be made via screws 63 in slots on bracket 34. This simplifies the software timing to accomplish image synchronization. Fourth, the italicizing angle $\beta$ may be adjusted to tilt the LED 32 column from the vertical. This may be accomplished via screw 61 and tilting of LED panel 38 to adjust the LED panel 30*a,b,c,d* to output italicized lettering and overcome differences in fan blade 16 angle (fan blades 16 are manufactured with a pitch to move air and the italicizing angle $\beta$ may be used to accommodate for the pitch). Fifth, the forward viewing angle $\theta$ to tilt the LED panel 3*a,b,c,d* forward and allow the image 60 to be viewed without distortion even though the majority of viewers (e.g. people dining at restaurant tables) may be viewing at an obtuse upward angle. This adjustment may be made via screw 65 in bracket 34. Also, many LEDs are manufactured specifically for signs. These LEDs have a wide horizontal output angle and a narrow vertical angle. If these LEDs were used in the fan display 10, the forward viewing angle adjust 65 would allow the LED panels 30*a,b,c,d* to point the brightest light at an angle down to the viewer. The possibility of the ceiling fan blades 16 of any particular unit 10 not being absolutely symmetrical makes all five adjustments necessary to assure that all the LED panels 30*a,b,c,d* travel/rotate in precisely the same cylindrical or conical plane and synchronize to achieve a crisp, pleasing image 60. Other modes of adjustment may be utilized to make the five adjustments. Proper mechanical alignment simplifies the software used in controller 20.

The Image or message 60 may also be customized by combining LEDs 32 to produce different colors. Each panel 30 may consist of at least two vertical rows of LEDs 32, a red LED 32 and a green LED 32. If the two LEDs 32 are activated in the same point in space starting within a hundredth of a second of each other for the same duration of time, the viewer would perceive a yellow line at that place. The image 60 may then output/include the colors red, green, yellow, and orange. Additional colors are possible if blue LEDs 32 are added to the panel 30.

The visibility or clarity of an image 60 is also enhanced by inserting dark non-reflective materials in the background and/or on the device 10. The first item is a cylindrical or conical background 50. Preferably, a dark conical background 50 may be attached by struts 52 to the center post 54 that suspends the ceiling fan 14. The average diameter of the conical backdrop 50 is less than (preferably slightly less than) the rotation diameter of the panels 30*a,b,c,d* such that the panels 30*a,b,c,d* visibly rotate in front of the dark background 50. With the LEDs 32 illuminated against a dark background 50, this contrast enhances the visibility of the image 60. Alternatively, a conical or cylindrical background 50 may be attached to the ceiling and suspended at a position that allows the message 60 to be viewed at many angles and still appear in front of the dark background 50. The second item is a dark, non-reflective finish applied to the LED panels 30*a,b,c,d*, fan motor casing, and the blades 16*a,b,c,d*. This is to reduce any brightness or reflections behind or near the image of any objects near the LEDs 32 that would distract the eye from the displayed message 60.

LED panels 30*a,b,c,d* are surrounded by aerodynamically shaped covers 40*a,b,c,d* which serve three primary functions. First, dust and other particulate are prevented from attaching directly to the LED 32. If dust does collect on or over the LED between the LED and the viewer; it will block light. The covers 40*a,b,c,d* smoothen the air flow over the LEDs 32 which limits dust collection to the leading edge 42 or 44 (depending on direction of rotation) (see FIG. 4) of the cover 40 and away from the interproximal surface 46 which prevents dust from collecting near, around, or on the LEDs 32. As a result, the LED 32 output or full angle illumination is not decreased with use. Second, the covers 40*a,b,c,d* are designated to reduce aerodynamic drag to achieve a higher rotational velocity and a cooler running fan motor. Third, the covers 40*a,b,c,d* cut through the air efficiently which reduces noise. Reducing noise minimizes customer distraction. The covers 40*a,b,c,d* may, for example, but not necessarily, be wing shaped and open at one end.

An optional cover transparent to infrared light may be used to protect the controller 20 and brushes 24*a,b*, while permitting infrared remote communications and providing an aesthetically pleasing appearance. Other modes of communication such as radio frequency may also be desirable to control the sign output, and upload or download messages to be displayed and software. The cover may be opaque if radio frequency is used.

The above disclosed display device 10 illustrates a novel means to display images 60 and messages 62. Customizing angle, color, and intensity parameters may produce images 60 ranging from a simple message to full color video graphics which may be stationary or moving. The display device 10 is relatively inexpensive providing users a commercially feasible means to advertise in a novel way using a ceiling fan 14.

Therefore, it is seen that the present invention and the embodiments disclosed herein are well adapted to carry out the objectives and obtain the ends set forth. Certain changes can be made in the subject matter without departing from the spirit and the scope of this invention. It is realized that changes are possible within the scope of this invention and it is further intended that each element or step to be recited in any claims is to be understood as referring to all equivalent elements or steps. Any claims are intended to cover the invention as broadly as legally possible in whatever form it may be utilized.

What is claimed is:

1. A ceiling fan image/message display apparatus, comprising:

a ceiling fan having a motor suspended from the ceiling by a center post and at least two supports driven by the motor;

a controller mounted on the apparatus;

a means for determining the rotational speed of the supports mounted on the apparatus;

a light source panel mounted on each of the supports and in communication with the controller; and a means for protecting each light source panel from dust mounted on each light source panel.

2. The apparatus according to claim 1, wherein the at least two supports comprise at least two blades.

3. The apparatus according to claim 1, further including a dark, non-reflective background mounted between the light source panels and the center post.

4. The apparatus according to claim 1, further including a means for individually and adjustably aligning each of the light source panels mounted on each of the supports.

5. The apparatus according to claim 4, wherein adjustable the aligning means comprises a means for vertically aligning the light source panels.

6. The apparatus according to claim 4, wherein the adjustable aligning means comprises a means for radially aligning each of the light source panels.

7. The apparatus according to claim 4, wherein the adjustable aligning means comprises a means for aligning the radial angle of each of the light source panels.

8. The apparatus according to claim 4, wherein the adjustable aligning means comprises a means for aligning an italicizing angle of each of the light source panels.

9. The apparatus according to claim 4, wherein the adjustable aligning means comprises a means for aligning a forward viewing angle of each of the light source panels.

10. A ceiling fan image/message display apparatus, comprising:

a ceiling fan having a motor suspended from the ceiling by a center post and a plurality of blades driven by the motor;

a controller mounted on the apparatus and powered by a set of auxiliary lines contained in the ceiling fan;

a means for determining the rotational speed of the blades mounted on the apparatus;

a plurality of light source panels each including a plurality of light sources, one each mounted proximate the end of each of the blades and each being in communication with the controller;

a plurality of aerodynamic covers, one each mounted over each light source panel wherein each aerodynamic cover includes a means for protecting the light sources from becoming covered with dust; and a dark, non-reflective background mounted between the light source panels and the center post.

11. The apparatus according to claim 10, further including a means for individually aligning each of the light source panels mounted on each of the blades.

12. The apparatus according to claim 11, wherein the aligning means comprises a means for vertically aligning the light source panels.

13. The apparatus according to claim 11, wherein the aligning means comprises a means for radially aligning each of the light source panels.

14. The apparatus according to claim 11, wherein the aligning means comprises a means for aligning the radial angle of each of the light source panels.

15. The apparatus according to claim 11, wherein the aligning means comprises a means for aligning an italicizing angle of each of the light source panels.

16. The apparatus according to claim 11, wherein the aligning means comprises a means for aligning a forward viewing angle of each of the light source panels.

17. The apparatus according to claim 10, wherein said dark, non-reflective background includes an upper edge having a larger diameter which tapers to a lower edge having a smaller diameter whereby said dark, non-reflective background has a conical configuration.

18. The apparatus according to claim 10, wherein at least one additional light source panel is mounted on each of the blades wherein the additional light source panels have a different colored light source.

19. The apparatus according to claim 10, wherein the light source panels have a dark, non-reflective finish.

20. The apparatus according to claim 10, wherein said dark, non-reflective background has a cylindrical configuration.

* * * * *